United States Patent [19]

Bies et al.

[11] Patent Number: 4,717,106

[45] Date of Patent: Jan. 5, 1988

[54] DISPLAY BRACKET FOR SOCKETS AND PACKAGE EMPLOYING SAME

[75] Inventors: Sylvester W. Bies, Bloomfield; Martin V. Fazio, Cheshire; George Matyczyk, Southington, all of Conn.

[73] Assignee: The Stanley Works, New Britain, Conn.

[21] Appl. No.: 369,405

[22] Filed: Apr. 19, 1982

[51] Int. Cl.[4] ..... A47H 1/10

[52] U.S. Cl. ..... 248/309.2; 211/70.6

[58] Field of Search ..... 248/309 A, 300, 309.2; 206/378, 193; 211/13, 60 T, 59.1, 70.6; 411/15, 60, 182

[56] References Cited

U.S. PATENT DOCUMENTS

| | | | |
|---|---|---|---|
| D. 147,623 | 10/1947 | Silvers | 248/309.2 X |
| 1,267,903 | 5/1918 | Pleister | 411/60 |
| 1,429,669 | 9/1922 | Zimmerman | 248/300 X |
| 1,626,539 | 4/1927 | Jones | 248/300 X |
| 1,712,473 | 5/1929 | McWethy . | |
| 2,452,713 | 11/1948 | Bandy . | |
| 2,455,885 | 12/1948 | Theurer . | |
| 2,575,843 | 11/1951 | Semrow . | |
| 2,835,465 | 5/1958 | Patterson . | |
| 3,143,917 | 8/1964 | Connor . | |
| 3,316,798 | 5/1967 | Johnson . | |
| 3,726,393 | 4/1973 | Thompson . | |
| 3,750,890 | 8/1973 | Smith et al. . | |
| 4,043,453 | 8/1977 | Greenlee . | |
| 4,159,768 | 7/1979 | Manis . | |
| 4,337,860 | 7/1982 | Carrigan | 211/60 T |

FOREIGN PATENT DOCUMENTS

| | | | |
|---|---|---|---|
| 1006076 | 3/1977 | Canada | 411/60 |
| 949040 | 9/1956 | Fed. Rep. of Germany | 206/378 |
| 935761 | 9/1963 | United Kingdom . | |
| 1036786 | 7/1966 | United Kingdom . | |
| 1291151 | 10/1972 | United Kingdom . | |
| 1477465 | 6/1977 | United Kingdom . | |
| 320179 | 10/1979 | United Kingdom . | |
| 2005372 | 11/1982 | United Kingdom . | |

*Primary Examiner*—Ramon S. Britts
*Assistant Examiner*—David L. Talbott

[57] ABSTRACT

An L-shaped, integrally formed bracket of one-piece construction provides packaging for wrench sockets and like articles. It has a post that is dimensioned and configured to snugly seat within the recess of the mounted socket, and will generally include a member to spread parts of the post and force them into positive engagement with the inner surfaces of the socket recess. The bracket is suited not only for use to protect the packaged article against damage and pilferage at the point-of-sale, but also for purposes of ongoing storage by the consumer.

5 Claims, 14 Drawing Figures

DISPLAY BRACKET FOR SOCKETS AND PACKAGE EMPLOYING SAME

BACKGROUND OF THE INVENTION

Tools used for turning threaded fasteners, such as nuts and bolts, often utilize interchangeable parts to engage the fastener; thus, socket wrenches and nut drivers with replaceable sockets and adapters are widely available. It is often desirable to sell the sockets or other such parts individually, and it is therefore necessary that packaging be provided which will not only protect the part, but which will also securely hold it and permit its identification while presenting it to the customer in an attractive manner. Although it is important that the contained article be capable of convenient removal from the package by the customer, it is also desirable that there be substantial inhibition to removal in the store, so as to discourage pilferage at the point of sale. It is also important, for economic and other practical reasons, that the package be of relatively simple and inexpensive construction.

Exemplary of the means heretofore proposed for the storage and display of wrench sockets is the holder described in Greenlee U.S. Pat. No. 4,043,453. The patentee indicates that the arrangement described in FIGS. 1–5 permits examination by the prospective customer, while inhibiting pilferage because of the difficulty of removing the fastening device used to attach the socket to the display card. However, the holder of the Greenlee patent is not very attractive, and it would provide little or no protection to the article. Moreover, the securing of the socket depends upon the presence of a detent hole in the socket, and assembly would not appear to be very facile.

To the consumer, it is often important that means be available by which the tools used can be conveniently organized and neatly stored. Hence, manufacturers appreciate the desirability of providing a package that not only permits display in a desirable manner at the point of sale, but that is also capable of reuse by the consumer for storage purposes. To achieve that end, it is of course necessary that the packaging be suitably designed and that it not be damaged or destroyed in the course of initial removal of the article; it is also important that the article be readily mounted upon, and dismounted from, the holder.

Accordingly, it is a primary object of the present invention to provide a novel bracket for the mounting of a wrench socket or like article, which bracket is adapted for packaging of the article to protect it, while securely holding the article and presenting it to the consumer in an attractive manner.

It is also an object of the invention to provide such a bracket which will securely retain the packaged article and discourage pilferage, while nevertheless permitting facile removal by the customer.

Another object of the invention is to provide a novel bracket which serves not only as packaging for the article, but is also suited for its subsequent storage.

Yet another object of the invention is to provide a bracket having the foregoing features and advantages, which is also relatively simple and is adapted for facile and inexpensive manufacture.

SUMMARY OF THE DISCLOSURE

It has now been found that the foregoing and related objects of the present invention are readily attained in a bracket comprised of an L-shaped, integrally formed body of one-piece construction, including a base wall, an upstanding back wall at the rear of the base wall, and a mounting post projecting upwardly from the base wall. The post is dimensioned and configured to snugly seat within the tool-engaging recess of a socket, thereby permitting it to be mounted in an upright position within the confines of the base wall.

Generally, the body of the bracket will be molded from a synthetic resinous material, and the base wall will be of generally rectangular configuration. In preferred embodiments, the body will additionally include an integrally formed lip which projects upwardly from along the front edge of the base wall.

The mounting post will desirably comprise retaining means for positively engaging the socket, which means may take the form of a plurality of outwardly projecting engagement elements, to engage within a channel or grooves formed into the inside surface of the socket recess. Most desirably, the post will be comprised of a plurality of resiliently deflectable elements or parts that are capable of lateral movement to vary the effective peripheral dimensions of the post. Such a bracket will preferably additionally include a member for spreading the parts of the post, with the base wall and post defining a passage for removably seating the spreading member, which will typically have a threaded shank portion thereon for engagement within the post. The back wall of the bracket will usually have an aperture in its upper end portion, to permit it to be hung on a supporting hook or the like.

DETAILED DESCRIPTION OF THE ILLUSTRATED EMBODIMENTS

Figure 1:
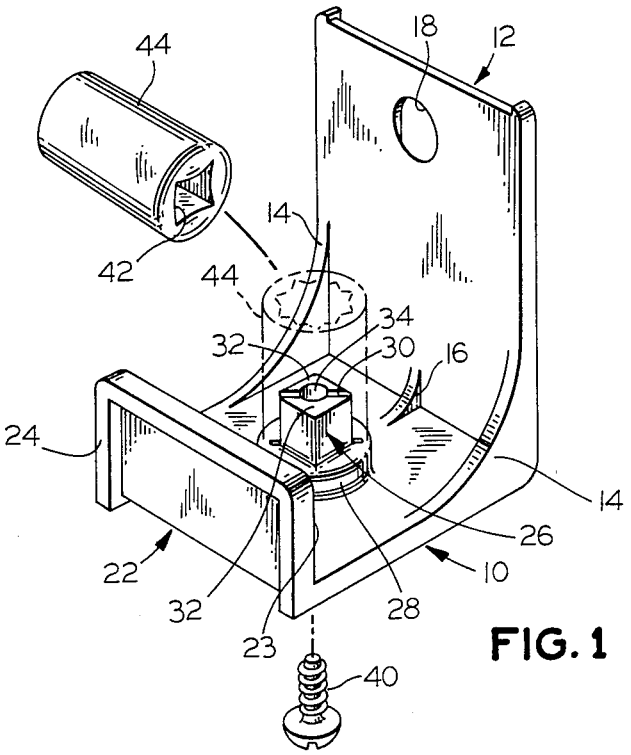
FIG. 1 is an exploded perspective view of a package embodying the present invention, showing the packaged wrench socket and threaded fastener removed from the mounting post, with the normally seated position of the socket shown in phantom line.
Figure 2:
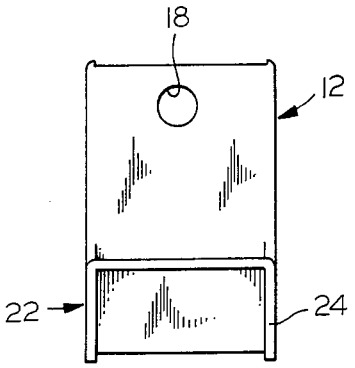
FIG. 2 is a front elevational view of the bracket of FIG. 1, drawn to a diminished scale.
Figure 3:
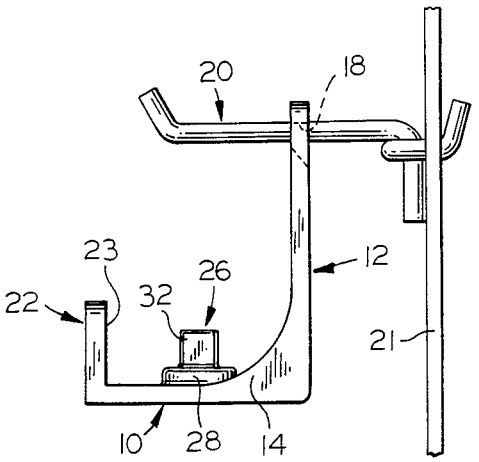
FIG. 3 is a side elevational view of the bracket, drawn to the scale of FIG. 2 and showing it mounted upon a peg-board hook.
Figure 4:
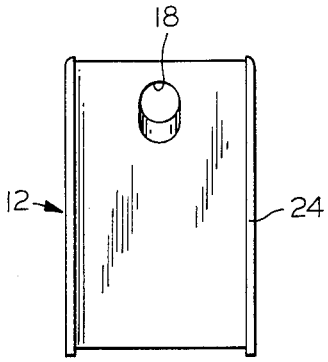
FIGS. 4, 5, and 6 are, respectively, rear, top and bottom plan views of the bracket, drawn to the same scale.
Figure 5:
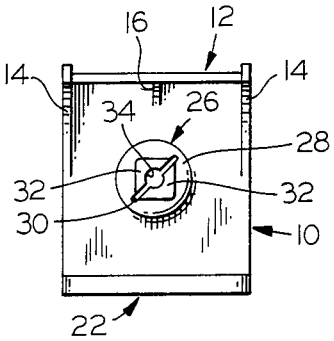
Figure 6:
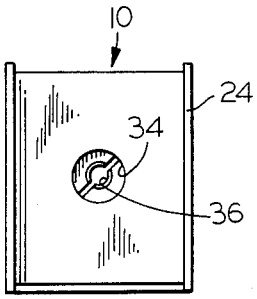
Figure 7:
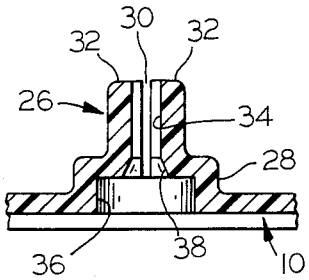
FIGS. 7 and 8 are fragmentary, sectional views of the mounting post of the bracket, drawn to an enlarged scale and showing, in FIG. 8, the threaded fastener engaged therewithin.

Turning now in detail to FIGS. 1–8 of the appended drawings, therein illustrated is a bracket embodying the present invention comprised of a one-piece molded plastic body including a rectangular base wall, geneally designated by the numeral 10. A back wall, generally designated by the numeral 12, extends upwardly from the rear edge of the base wall 10, and reinforcing ribs 14, 16 are provided at the sides and center of the juncture between the two portions, respectively. An aperture 18 (which may, in practice, be a simple hole) is provided in the upper end portion of the back wall 12, permitting the bracket to be suspended from a hanger, generally designated by the numeral 20, which is in turn supported by a peg-board panel 21, as shown in FIG. 3. A low front wall or lip, generally designated by the numeral 22, projects upwardly from along the forward edge of the base wall 10, and a flange 24 extends peripherally about the body, except along the top of the back wall to better accommodate a label, which may be wrapped thereover. The back wall 12 and the front wall 22 together define a protective enclosure or well 23; as indicated, they also provide convenient areas upon which advertising and identifying information can be presented.

A post, generally designated by the numeral 26, is integrally formed on the base wall 10, and consists of a circular base portion 28, and a rectangular portion of smaller cross-section, which is diagonally split at 30 to divide it into two portions 32 of generally triangular cross-section. An axial bore 34 is formed through the base wall 10 and post 26, and includes an enlarged, counterbore portion 36 within the circular base portion 28, and a frustoconical transition portion 38.

Figure 8:
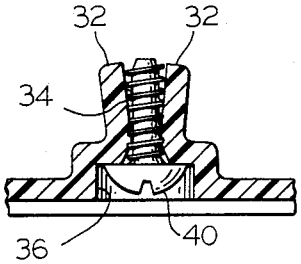

As is best seen in FIG. 8, a threaded fastener 40, such as a screw of the "push-type", is inserted into the bore 34 with its head within the counterbore 36. The fastener is of a diameter sufficiently large to spread the triangular portions 32 outwardly into frictional engagement upon the inside surfaces of the tool-receiving recess 42 of the socket 44 seated thereon, it being noted that the displacement of the portions 32 is exaggerated in FIG. 8 for purposes of illustration. Although the socket 44 is thereby securely mounted and protected against damage and pilferage, it can nevertheless be readily removed simply by unscrewing the fastener 40.

Figure 9:
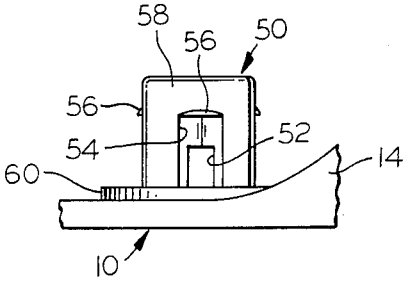
FIGS. 9, 10, and 11 are, respectively, fragmentary side elevational, top and bottom plan views of the base of a second embodiment of the mounting brackets of the present invention.
Figure 10:
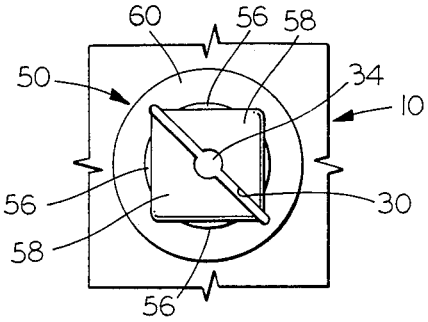
Figure 11:
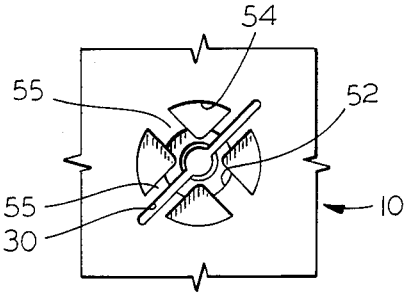

Turning now to FIGS. 9–11, the base of a second embodiment of the bracket is fragmentarily illustrated therein, which essentially consists of the same parts as the bracket of the previously discussed figures; the same numbers are used to the extent that common parts are shown. The principal difference between the two embodiments resides in the structure of the mounting post, which is in this instance generally designated by the numeral 50. Not only is the enlarged counter-bore portion 52 somewhat deeper (relative to the overall height of the post 50) than is the corresponding portion 36 of the post 26, but there are also passages 54 communicating therewith and extending through the sides of the post, which define internal rib portions 55. This design permits the formation of the four small teeth or engagement elements 56, on the outer surfaces of the sections 58 of the post 50, using tooling that passes upwardly therethrough. The teeth 56 afford an enhanced grip upon the inner surfaces of the socket recess which, at least in the larger sizes, may be provided with internal grooves or channels in which the teeth can engage.

Figure 12:
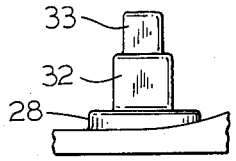
FIG. 12 is a fragmentary side elevational view of the base of another embodiment of the brackets of the invention, in which a stepped form of mounting post is provided.

FIG. 12 illustrates a modification wherein the post of the bracket has a "stepped" structure. Thus, in addition to the circular base portion 28 and portions 32 of triangular cross-section, as shown in the embodiment of FIGS. 1–8, the post of the bracket of this Figure includes a smaller upper rectangular structure consisting of triangular portions 33 (only one of which is visable, but which are, except for dimensions, substantially the same as the portions 32). This will enable the bracket to hold either of two sizes of wrench sockets, e.g., $\frac{3}{8}$ and $\frac{1}{2}$ inch.

Figure 13:
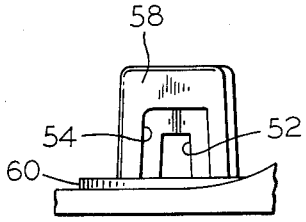
FIGS. 13 and 14 are, respectively, fragmentary side elevational and bottom plan views of the base of yet another embodiment of the present brackets.
Figure 14:
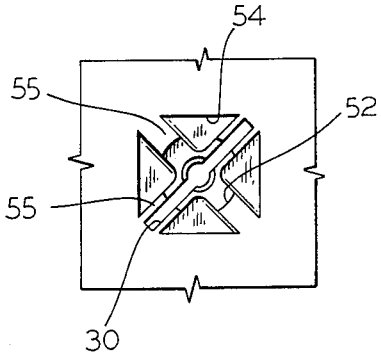

Turning finally to FIGS. 13 and 14, the post structure shown is quite similar to that of FIGS. 9–11, and will similarly be used for the larger drive size sockets. Since, however, the teeth 56 are not present in this embodiment, the large base opening may conveniently be of a square, rather than of a round, configuration; thus, at the base of the bracket the passages 54 are, in this instance, substantially triangular, whereas those of the preceeding figures are of generally sectorial cross-section.

Although the post structures illustrated are considered to be optimum for the achievement of the objectives of the present invention, variations in the construction and configuration thereof are, of course, possible without departing from the scope of the invention. For example, rather than providing a square cross-sectional configuration, the upper end of the post may take the form of a multiplicity of fingers, which can be forced by appropriate means into gripping engagement with the socket to be mounted thereon. Such a construction might offer the advantage of more universal application, since parts having recesses of other than square cross-sectional configuration could more readily be seated thereupon. In this regard, it should be understood that, although the portion of the post that seats within the recess will generally correspond in cross-sectional configuration to that of the recess (e.g., of square, hexagonal, or other polygonal configuration), posts of curvilinear or non-conforming cross-section can also be used in appropriate instances.

The dimensions of the post will, of course, vary to conform to the size of the recess in the socket. As is well known, socket wrenches and the like are sold in several conventional sizes of the stud upon which the socket is mounted; e.g., $\frac{1}{4}$ inch, $\frac{3}{8}$ inch, $\frac{1}{2}$ inch, and metric variants.

While greatest security will be provided when a spreading member, such as the threaded fastener shown in the drawings, is utilized to positively force the sections of the post into engagement with the mounted article, such an arrangement may not be desired in all instances. Thus, for some purposes adequate gripping force may be exerted as a result of the inherent resiliency of the post itself. In any event, the consumer may well wish to utilize the bracket without replacing the spreading member, since he will not be concerned about pilferage and may find it more convenient to use the bracket without the fastener. It will also be readily apparent to those skilled in the art that a wide variety of members can be employed in place of the threaded fastener shown in the drawings. Nevertheless, the use of push type screws is particularly advantageous, due to the ease with which they can be assembled during automated packaging operations, and removed by a consumer equipped with a screwdriver.

The bracket of the invention can readily be produced by conventional molding techniques, as will be appreciated by those skilled in the art. A wide variety of plastics can of course be utilized, including the polystyrenes, polyolefins, polyesters, polyamides, and vinyl chloride polymers and copolymers, provided that they afford the requisite levels of strength and toughness, consistent with good economy; acrylonitrile/-butadiene/styrene copolymers are particularly preferred. Structural variations in the bracket may result from the production practices used, such as to accommodate taper of the post, which provides the draft necessary to permit facile ejection from the mold.

Thus, it can be seen that the present invention provides a novel bracket for the mounting of a wrench socket or like article, which bracket is adapted for packaging of the article so as to protect and identify it, while also securely holding the article and presenting it to the consumer in an attractive manner. The bracket securely retains the packaged article and discourages pilferage while nevertheless permitting easy removal by the customer, and it is suited for ongoing storage of the article. The bracket of the invention is relatively simple, and is adapted for facile and inexpensive manufacture.

Having thus described the invention, what is claimed is:

1. A bracket for mounting and displaying a wrench socket or the like, comprised of a generally L-shaped, self-supporting rigid body integrally formed as a single piece from a synthetic resinous material, said body including a generally planar base wall, an upstanding, generally planar back wall extending along the rear of, and being of substantially the same width as, said base wall, and a mounting post projecting upwardly from said base wall inwardly of the periphery thereof in spaced relationship to said back wall and parallel to the plane thereof, said post being dimensioned and configured to snugly seat within the tool-engaging recess of the socket, said post including a plurality of resiliently deflectable elements, said elements being capable of lateral movement to vary the effective peripheral dimensions of said post, a member for spreading said elements, said elements cooperatively defining an opening receiving said spreading member therebetween, and said member being dimensioned and configured to spread said elements and thereby increase the normal peripheral dimensions of said post when inserted into said opening, said post and said spreading member comprising retaining means on said bracket, and said back wall having means at its upper end portion to permit hanging of said bracket on a hook or the like, whereby the socket can be mounted for display and storage in an upright position, protectively sheltered within the confines of said base wall and said back wall as defined respectively by the upward and forward projections thereof.

2. The bracket of claim 1 wherein said base wall and said post have a passage therein for removably seating said spreading member.

3. The bracket of claim 2 wherein said spreading member has a threaded shank portion thereon engaged within said post.

4. A display and storage package including: a bracket comprised of a generally L-shaped, self-supporting rigid body integrally formed as a single piece from a synthetic resinous material, said body including a generally planar base wall, an upstanding, generally planar back wall extending along the rear of, and being of substantially the same width as, said base wall, and a mounting post projecting upwardly from said base wall inwardly of the periphery thereof in spaced relationship to said back wall and parallel to the plane thereof, said post being dimensioned and configured to snugly seat within the tool-engaging recess of a socket, said post being comprised of a plurality of resiliently deflectable elements, said elements being capable of lateral movement to vary the effective peripheral dimensions of said post, a member for spreading said deflectable elements, said base wall and said post having a passage therein for removably seating said spreading member, and said member being dimensioned and configured to spread said deflectable elements and thereby increase the normal peripheral dimensions of said post, and said back wall having means at its upper end portion to permit hanging of said bracket from a hook or the like; a wrench socket mounted upon said post in upright position with said post seated snugly within the tool engaging recess of said socket; comprising said deflectable elements and said spreading member, whereby said socket is mounted for display and storage in an upright position, protectively sheltered within the confines of said base wall and said back wall as defined respectively by the upward and forward projections thereof.

5. The package of claim 4 wherein said spreading member has a threaded shank portion thereon engaged within said post.

* * * * *